US007896413B2

(12) United States Patent
Shen Ku

(10) Patent No.: US 7,896,413 B2
(45) Date of Patent: Mar. 1, 2011

(54) TWO-SECTION CHOPSTICKS WITH AN IMPROVED STRUCTURE

(76) Inventor: Chun-Lan Shen Ku, Puli Township, Nantou County (TW)

( * ) Notice: Subject to any disclaimer, the term of this patent is extended or adjusted under 35 U.S.C. 154(b) by 0 days.

(21) Appl. No.: 12/253,960

(22) Filed: Oct. 18, 2008

(65) Prior Publication Data

US 2010/0259054 A1 Oct. 14, 2010

(51) Int. Cl.
*A47G 21/10* (2006.01)

(52) U.S. Cl. ..... 294/1.1; 294/5.5

(58) Field of Classification Search ..... 294/1.1, 294/5.5, 99.2; 30/322, 324, 340; 403/377
See application file for complete search history.

(56) References Cited

U.S. PATENT DOCUMENTS 7,093,868 B1 * 8/2006 Shen ..... 294/1.1
7,258,375 B1 * 8/2007 Shen ..... 294/1.1
7,341,293 B2 3/2008 Tsai
7,571,943 B1 * 8/2009 Lee ..... 294/1.1
2008/0079274 A1 * 4/2008 Shen Ku ..... 294/1.1
2008/0185853 A1 8/2008 Shen

FOREIGN PATENT DOCUMENTS

JP 11-4744 * 1/1999

* cited by examiner

*Primary Examiner*—Dean J Kramer
(74) *Attorney, Agent, or Firm*—Wang Law Firm; Li K. Wang

(57) ABSTRACT

A two-section chopstick with an improved structure has an upper section, a lower section, and a limiting element. The limiting element is mounted around the sidewall near the bottom end of the upper section. The limiting element has a bent fixing part going through a through hole on the sidewall near the bottom end of the upper section. The fixing part extends into an accommodating space inside the upper section. The fixing part holds a connecting section of the lower section to secure the connection between the upper section and the lower section. Alternatively, a holding section in the lower section can be inserted into the accommodating space, thereby storing the chopstick.

6 Claims, 9 Drawing Sheets

TWO-SECTION CHOPSTICKS WITH AN IMPROVED STRUCTURE

BACKGROUND OF THE INVENTION

1. Field of Invention

The invention relates to two-section chopsticks with an improved structure and, in particular, to two-section chopsticks with a simple structure and easy manufacturing method.

2. Related Art

Please refer to FIG. 8 that shows a conventional two-section chopstick 4 disclosed in the U.S. Pat. App. No. 20,080,185,853. A connection component 41 is disposed on a lower section 42 for it to connect with an upper section 43. The connection component 41 includes a connection body 411 and a fixing set 412. The fixing set 412 further includes an elastic element 413, an urging element 414, and an accommodating cylinder 415. Alternatively, the lower section 42 can be inserted in reverse into the upper section 43, and held by a holding part 441 of a cover 44. The two-section chopstick 4 can thus be put away.

However, such a two-section chopstick 4 has too many components. Not only is its manufacturing cost higher, it also takes a long time to assemble them.

Please refer to FIG. 9, which shows another conventional two-section chopstick 5 disclosed in the U.S. Pat. No. 7,341,293. It comprises an upper section 51 and a lower section 52. A ball 53 on the connecting section 521 of the lower section 52 is disposed in an accommodating space 522 via a spring 54 and a fixing block 55. The lower section 52 is thus held in the through hole 511 of the upper section 51. Alternatively, the user can draw the lower section 52 and insert it into the accommodating space 512 on top of the upper section 51. Thus, the two-section chopstick 5 can be put away.

There are still quite a few components in such a two-section chopstick 5. During the manufacturing process, if the ball 53, the accommodating space 522, or the through hole 511 has any error, the lower section 52 cannot be held properly by the upper section 51. There is thus space for improvement.

SUMMARY OF THE INVENTION

An objective of the invention is to solve the above-mentioned problems by providing a two-section chopstick with an improved structure. The bottom end of an upper section is mounted with a limiting element. Using such a simple component, a lower section can be firmly fixed in position. This is one advantage over the prior art.

Another objective of the invention is to provide a means to achieve a firm connection between the upper and lower sections without high machining precision. Each component in the invention only needs to be processed in a simple way. Therefore, the manufacturing time can be greatly reduced.

To achieve the above-mentioned objectives, the invention discloses a two-section chopstick with an improved structure that comprises: an upper section, a lower section, and a limiting element.

The upper section has an accommodating space therein. A connecting part is disposed around the outer sidewall near the bottom end of the upper section. The connecting part is formed with at least one through hole in communication with the accommodating space.

A protruding part is disposed around and near the top end of the lower section. Between the protruding part and the top end is a connecting section. Between the protruding part and the bottom end is a holding section. The connecting section has a first urging part near the protruding part. The holding section has a second urging part near the protruding part.

The limiting element has an opening end at its upper and lower ends, respectively. It is mounted on the connecting part. The limiting element is formed with at least one elastic fixing part. The fixing part goes through the through hole and enters the accommodating space.

The connecting section is inserted into the accommodating space, and the fixing part holds the first urging part. Alternatively, the holding section is inserted in the accommodating space, and the fixing part holds the second urging part.

One of the two ends of the fixing part is connected with the limiting element.

There is at least one protruding part near the top end of the upper section. The protruding part holds the clicking part of a cover. The top end of the cover has at least one protruding part.

The thickness of the limiting element is greater than that of the holding part. The width of the upper end of the limiting element is greater than that of its lower end. The lower end is further surrounded with a bending part.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
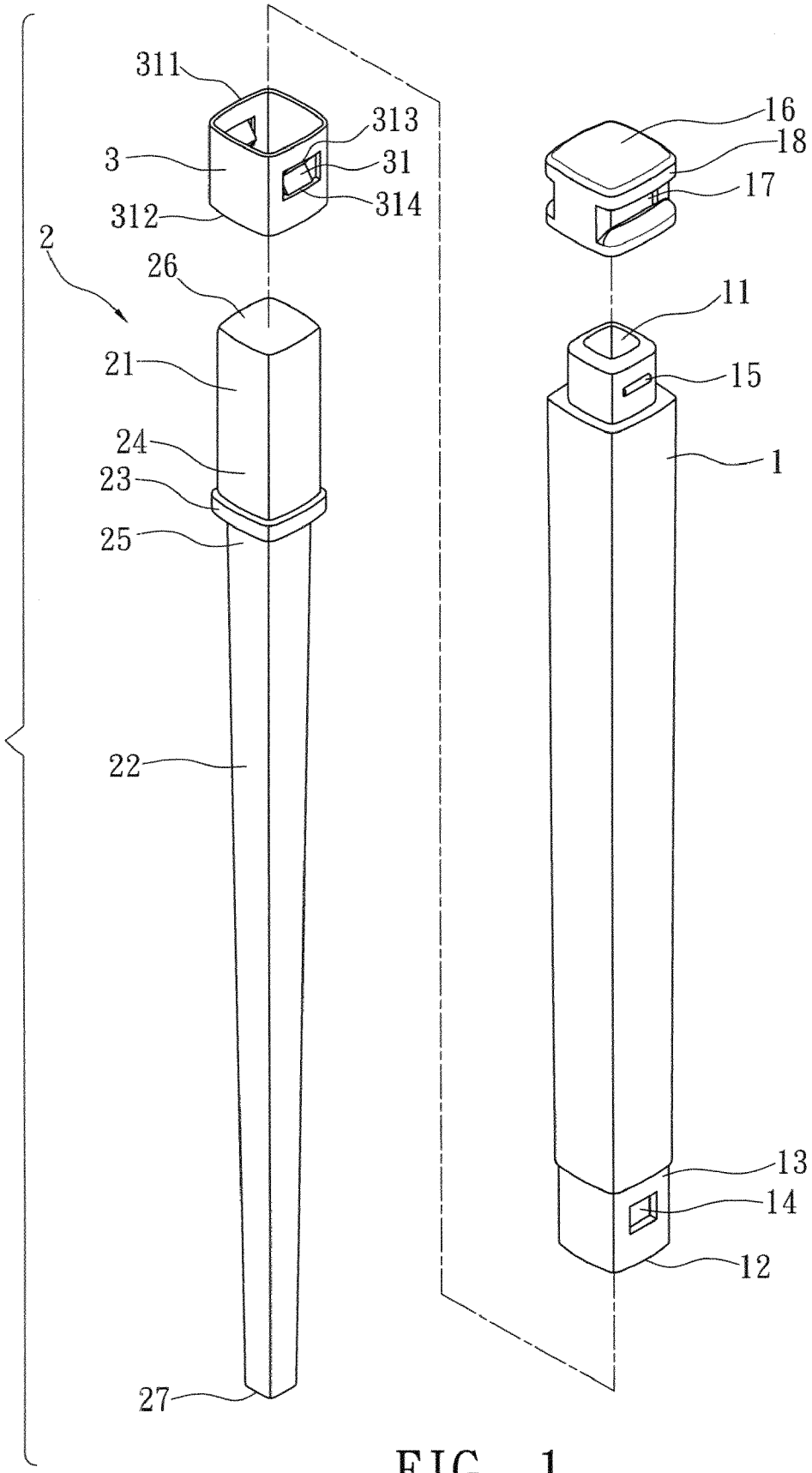
FIG. 1 is a three-dimensional exploded view of a first embodiment of the invention.
Figure 2:
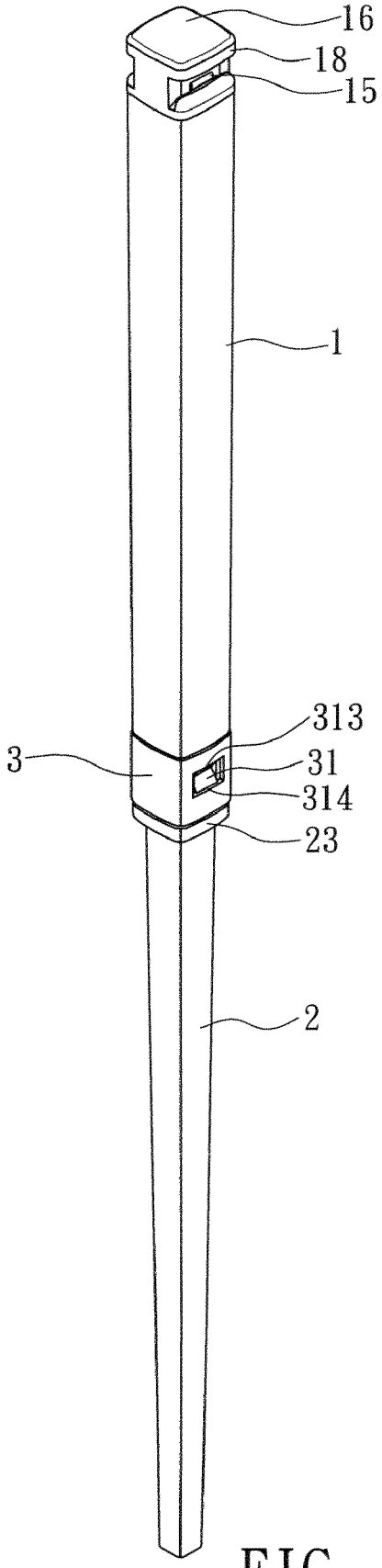
FIG. 2 is a three-dimensional view of the first embodiment.
Figure 3:
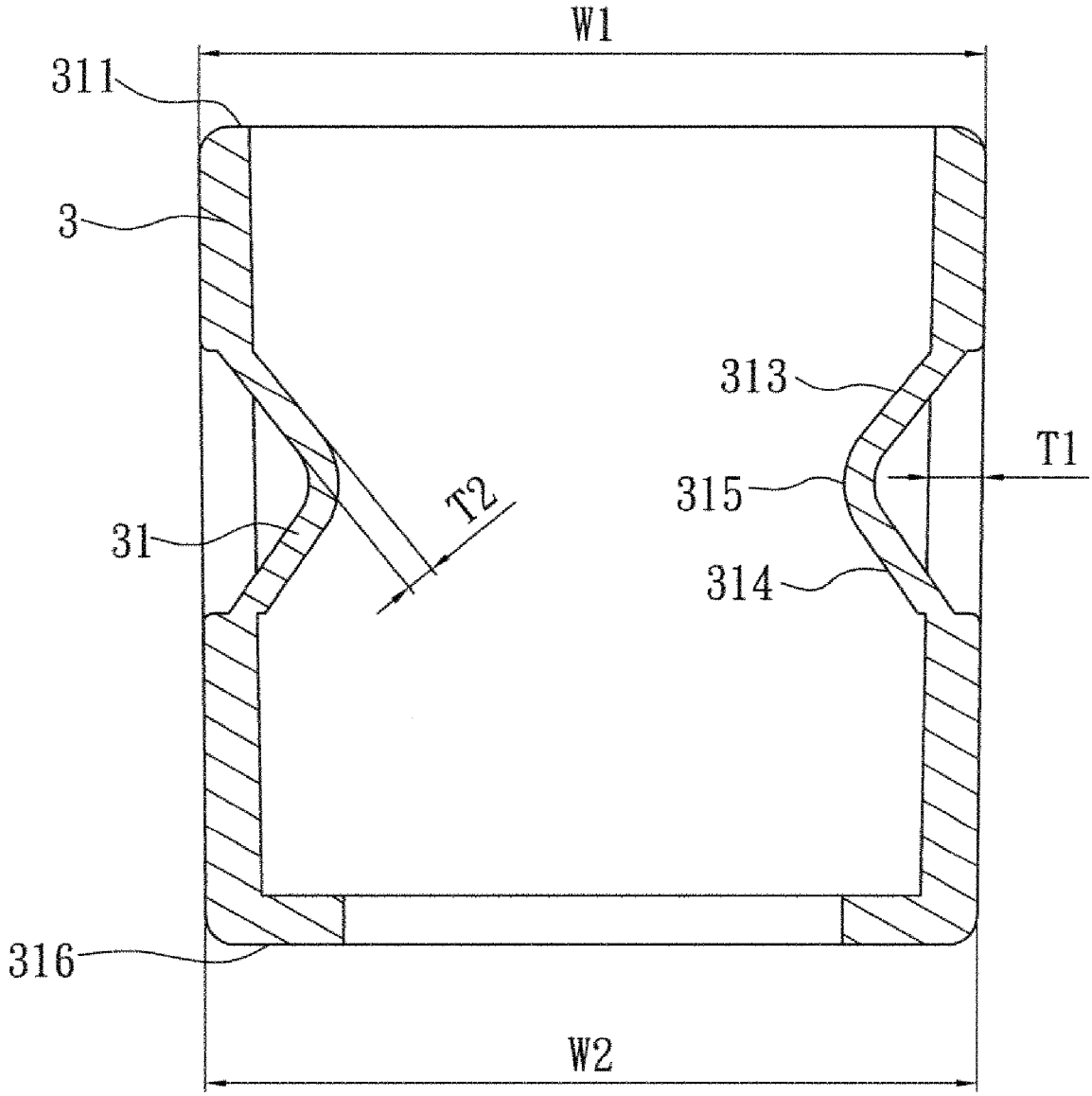
FIG. 3 is a cross-sectional view of the limiting element in the first embodiment.

Please refer to FIGS. 1 to 3 for a first embodiment of the disclosed two-section chopstick.

The chopstick includes an upper section 1, a lower section 2, and a limiting element 3. In this embodiment, the cross sections of the-above three components are all square. Moreover, the dimension of the cross section gradually reduces from top to bottom.

The upper section 1 has an accommodating space 11 therein for the insertion of the lower section 2. Besides, a connecting part 13 is formed around the outer sidewall near the bottom end 12 of the upper section 1. The connecting part 13 has a concave shape and is thinner than the upper section 1. The two opposite sides of the connecting part 13 are formed with through holes 14 in communication with the accommodating space 11, respectively.

According to the drawing, the lower section 2 defines a top end 26 and a bottom end 27. A protruding part 23 is formed around and near the top end 26 of the lower section 2. Between the protruding part 23 and the top end 26 is a connecting section 21, and between the protruding part 23 and the bottom end 27 is a holding section 22. The protruding part 23 can control the depth of the connecting section 21 or the holding section 22 when it is inserted into the accommodating space 11 of the upper section 1. A first urging part 24 is defined on the connecting section 21 near the protruding part 23. A second urging part 25 is defined on the holding section 22 near the protruding part 23.

The limiting element 3 has an annular shape. Its upper end 311 and lower end 312 are open ends. It is mounted on the connecting part 13 at the bottom end 12 of the upper section 1. A bending part 316 surrounds the lower end 312 of the limiting element 3 and extends inwards. An elastic fixing part 31 is provided on two opposite sides of the limiting element 3. Each of the fixing parts 31 goes through the through hole 14 on the upper section 1, and protrudes in the accommodating space 11 of the upper section 1. The first urging part 24 or the second urging part 25 of the lower section 2 is thus held by them, thereby being positioned in the lower section 2.

The maximum width W1 of the upper end 311 of the limiting element 3 is greater than the maximum width W2 of the lower end 312. The limiting element 3 is connected to the connecting part 13 that has a reducing cross section from top to bottom. Since the connecting part 13 has a concave shape, mounting the limiting element 3 on the connecting part 13 can avoid user's discomfort.

Each of the fixing parts 31 of the limiting element 3 has an upper part 313 slanted toward the central position and downwards, a lower part 314 slanted in the opposite direction, and a middle part 315 connecting the upper part 313 and the lower part 314. In this embodiment, the upper part 313 and the lower part 314 are both connected with the limiting element 3.

Moreover, the limiting element 3 in this embodiment is made of stainless steel with malleability. Therefore, after stamp formation, the thickness T2 of the fixing part 31 of the limiting element 3 (i.e., the thickness of the upper part 313, the lower part 314, and the middle part 315) is smaller than the thickness T1 of the limiting element 3.

Besides, there is at least one protruding part 15 near the top end of the upper section 1. The protruding part 15 holds the clicking part 17 of a cover 16. The top end of the cover 16 has at least one protruding part 18 for the convenience of taking off.

Figure 4:
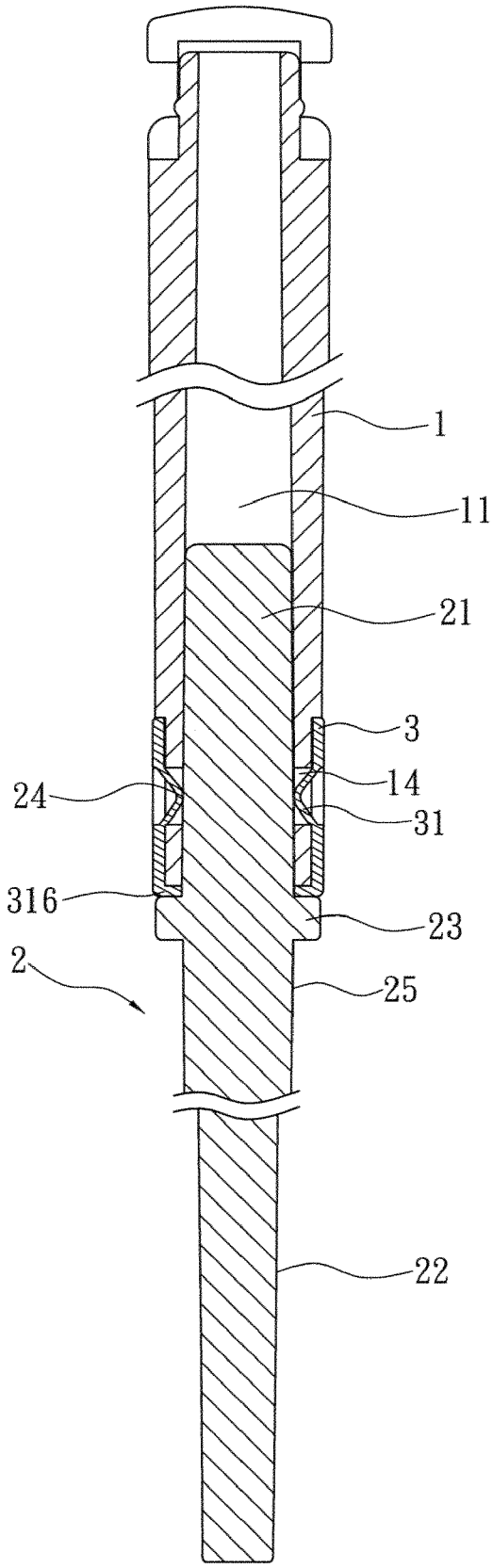
FIG. 4 is a cross-sectional view showing how the first embodiment works.

Please refer to FIG. 4. The connecting section 21 of the lower section 2 is inserted into the accommodating space 11 of the upper section 1. In this case, the protruding part 23 of the lower section 2 blocks the holding section 22 from entering. This completes the first stage of positioning. Afterwards, the first urging part 24 of the connecting section 21 is held by the fixing part 31 protruding from the limiting element 3 to the accommodating space 11. This completes the second stage of positioning. Up to this point, the upper section 1 and the lower section 2 are firmly connected for use.

Figure 5:
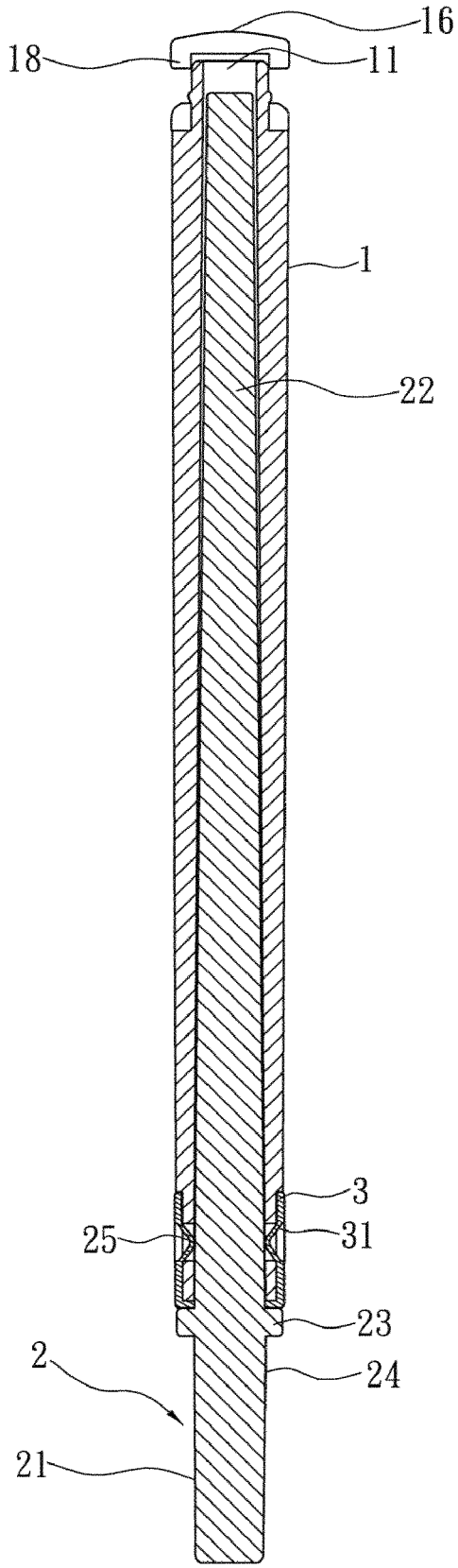
FIG. 5 is a cross-sectional view showing how the first embodiment is put away.

Please refer to FIG. 5 for putting the chopstick away. First, the connecting section 21 of the lower section 2 is pulled out of the accommodating space 11 of the upper section 1. Afterwards, the lower section 2 is reversed. The holding section 22 is inserted into the accommodating space 11. In this case, the protruding part 23 prevents the entire lower section 2 from falling into the accommodating space 11. Afterwards, the fixing part 31 also holds the second urging part 25 of the holding section 22. This is the second stage of urging and fixing. This reduces the volume for carrying.

To clean relevant components, one simply pulls the lower section 2 from the bottom end of the upper section 1. Afterwards, one can pull the cover 16 away from the top end of the upper section to clean the interior of the upper section 1.

Figure 6:
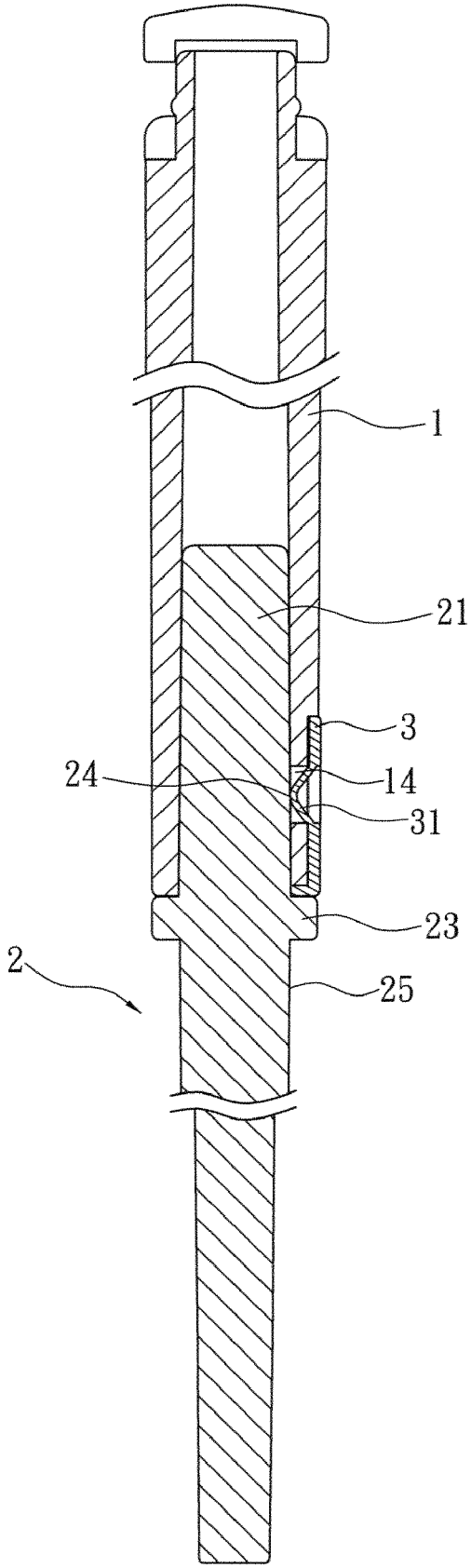
FIG. 6 is a cross-sectional view of a second embodiment of the invention.

Of course, the invention has many other embodiments. Please refer to FIG. 6 for a second embodiment of the invention. In particular, the limiting element 3 has only a fixing part 31 that bends and goes through the through hole 14. The single-sided fixing part 31 holds the first urging part 24 for the user to use. Alternatively, the lower section 2 is rotated in reverse so that the fixing part 31 holds the second urging part 25. The lower section 2 is thus accommodated in the upper section 1.

Figure 7:
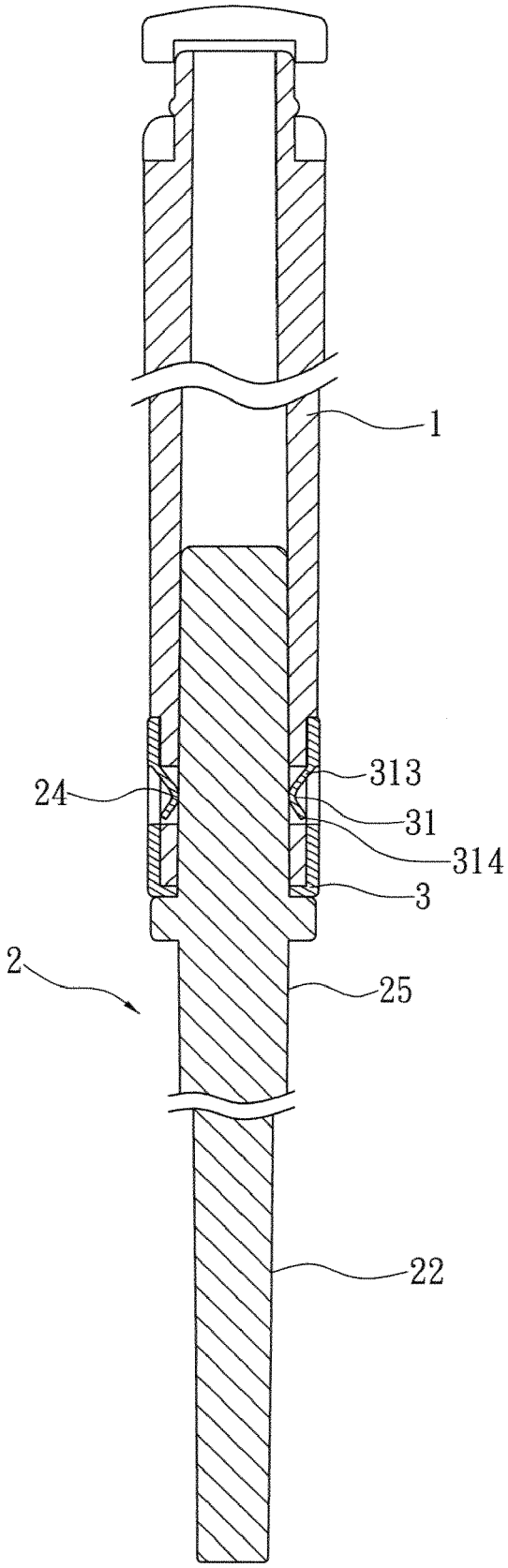
FIG. 7 is a cross-sectional view of a third embodiment of the invention.
Figure 8:
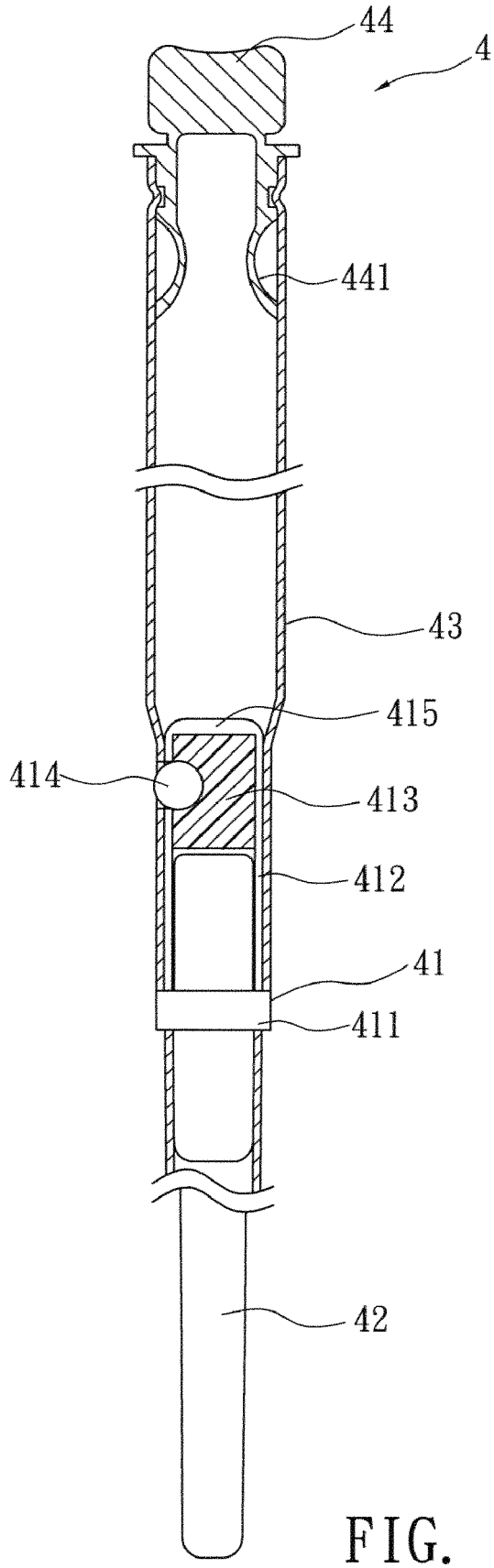
FIG. 8 PRIOR ART
FIG. 8 is a schematic view showing the structure of a conventional two-section chopstick.
Figure 9:
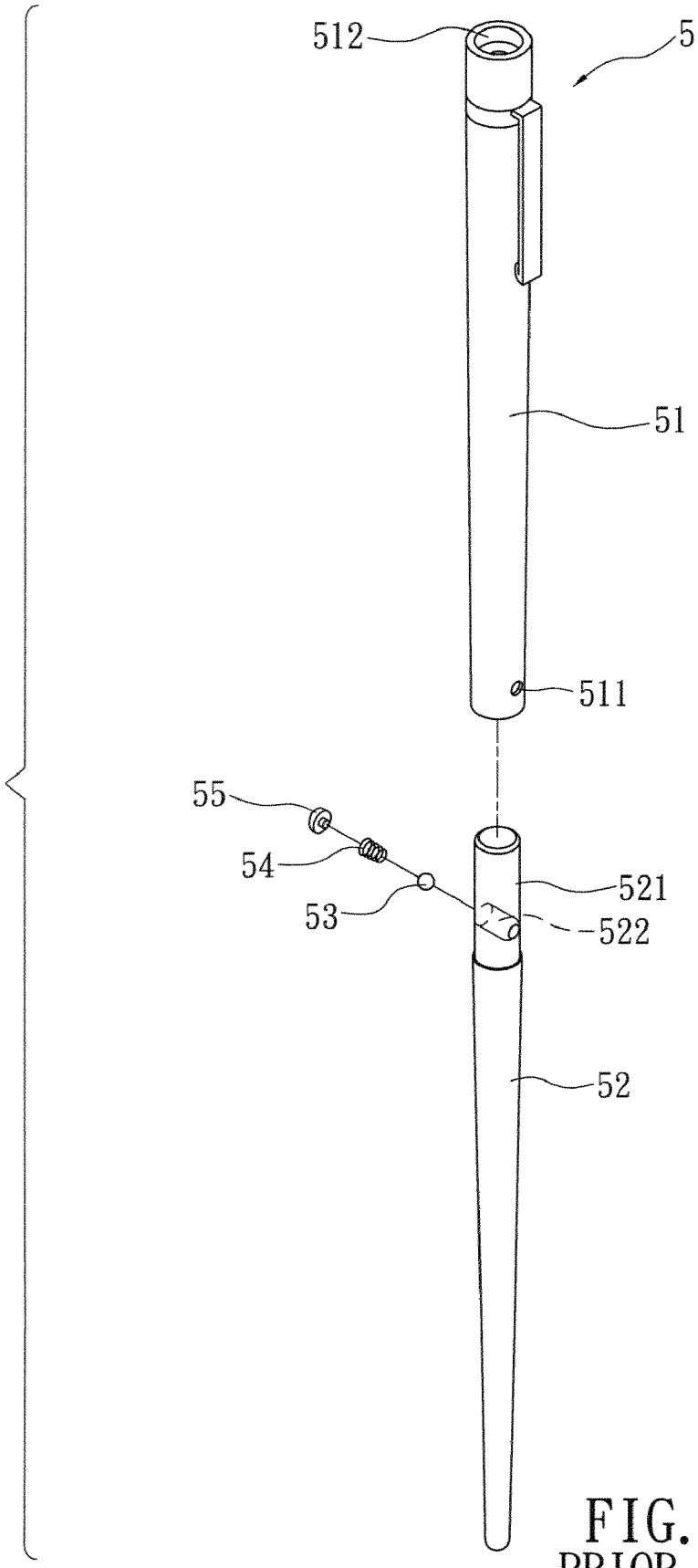
FIG. 9 PRIOR ART
FIG. 9 is a schematic view showing the structure of another conventional two-section chopstick.

Please refer to FIG. 7 for a third embodiment of the invention. The lower part 314 is not connected with the limiting element 3, whereas the upper part 313 is connected with the limiting element 3. Using such a mechanism, the fixing part 31 holds the first urging part 24 or the second urging part 25.

Alternatively, the upper part 313 is not connected with the limiting element 3, whereas the lower part 314 is connected with the limiting element 3. Accordingly, the fixing part 31 holds the first urging part 24 or the second urging part 25. The upper section 1 and the lower section 2 are thus fixed for the user to use or put away.

In summary, the disclosed two-section chopsticks use such simple components as the limiting element, upper section, and lower section. Under manufacturing conditions with appropriately reduced machining precision, the upper section and the lower section can be firmly connected for use and storage. This helps increasing the production rate. Moreover, the invention has the advantages of small volume, being portable, easy to clean, convenient in use, and quick assembly or disassembly.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A two-section chopstick with an improved structure, comprising:

an upper section with a bottom end, the bottom end having an outer sidewall, the upper section having an accommodating space therein and a connecting part around the outer sidewall near the bottom end thereof, the connecting part having at least one through hole in communication with the accommodating space;

a lower section with a top end and a bottom end, the lower section being provided with a protruding part near the top end, a connecting section between the protruding part and the top end, and a holding section between the protruding part and the bottom end, the connecting section having a first urging part near the protruding part and the holding section having a second urging part near the protruding part; and a limiting element, which has upper and lower open ends, is mounted on the connecting part, and has at least one elastic fixing part with upper, middle, and lower parts going through the through hole into the accommodating space;

wherein the connecting section is inserted into the accommodating space and the fixing part holds the first urging part, or the holding section is inserted into the accommodating space and the fixing part holds the second urging part.

2. The two-section chopstick with an improved structure of claim 1, wherein at least one of the upper and lower parts of the fixing part is connected with the limiting element.

3. The two-section chopstick with an improved structure of claim 1, wherein the upper section has at least one protruding part near the top end, the protruding part holds a clicking part of a cover, and the top end of the cover has at least one protruding part.

4. The two-section chopstick with an improved structure of claim 1, wherein the thickness of the fixing part is smaller than the thickness of the limiting element.

5. The two-section chopstick with an improved structure of claim 1, wherein the width of the upper end of the limiting element is greater than the width of the lower end.

6. The two-section chopstick with an improved structure of claim 1, wherein the lower end of the limiting element is surrounded by a bending part.

* * * * *